US006805640B2

(12) United States Patent
Kim et al.

(10) Patent No.: US 6,805,640 B2
(45) Date of Patent: Oct. 19, 2004

(54) GOLF SWING TRAINING AID

(76) Inventors: Sang-Kwang Kim, 515-301, 27 Apt., Jamsil-dong, Songpa-ku, Seoul (KR); Boo-Yang Kim, 515-301, 27 Apt., Jamsil-dong, Songpa-ku, Seoul (KR)

( * ) Notice: Subject to any disclaimer, the term of this patent is extended or adjusted under 35 U.S.C. 154(b) by 0 days.

(21) Appl. No.: 10/341,398

(22) Filed: Jan. 14, 2003

(65) Prior Publication Data

US 2003/0148814 A1 Aug. 7, 2003

(30) Foreign Application Priority Data

Feb. 1, 2002 (KR) ..... 20-2002-3265
Oct. 2, 2002 (KR) ..... 20-2002-29492

(51) Int. Cl.[7] ..... A63B 69/36
(52) U.S. Cl. ..... 473/226
(58) Field of Search ..... 473/226, 227, 473/219, 201, 204, 205, 206, 212, 213, 214, 276

(56) References Cited

U.S. PATENT DOCUMENTS 5,145,179 A * 9/1992 Breed ..... 473/212
5,156,401 A * 10/1992 Hodgkiss ..... 473/227
5,203,568 A * 4/1993 Vasquez ..... 473/212
5,248,146 A * 9/1993 Viets et al. ..... 473/206
5,470,073 A * 11/1995 Vasquez ..... 473/206
5,711,716 A * 1/1998 O'Brien et al. ..... 473/212
5,865,685 A * 2/1999 Thomas ..... 473/213
5,902,189 A * 5/1999 Schultz ..... 473/212
5,904,624 A * 5/1999 Martinez ..... 473/212
6,004,221 A * 12/1999 Thornhill ..... 473/227
6,447,402 B2 * 9/2002 Moran ..... 473/226

* cited by examiner

*Primary Examiner*—Gregory Vidovich
*Assistant Examiner*—Nini F. Legesse
(74) *Attorney, Agent, or Firm*—Robert E. Bushnell, Esq.

(57) ABSTRACT

The present invention provides a golf swing training aid to which a golf club is attached. The golf swing training aid according to the present invention comprises a first supporting member having an end portion and two branch portions arranged at the rear of the end portion, second supporting members connected to ends of the branch portions of said first supporting member by means of couplers for supporting the back portions of the lower arms of the golfer so that the distance between both arms is maintained, and a stationary plate and a moving plate mounted at the end portion of said first supporting member for holding fixedly the shaft of the golf club.

20 Claims, 10 Drawing Sheets

GOLF SWING TRAINING AID

CLAIM OF PRIORITY

This application claims priority under 35 U.S.C. §119 to my application entitled "GOLF SWING TRAINING AID" filed in the Korean Industrial Property Office on Feb. 1, 2002 and assigned Serial No. 2002-3265, and filed on Oct. 2, 2002 and assigned Serial No. 2002-29492, the contents of which are hereby incorporated by reference.

BACKGROUND OF THE INVENTION

1. Field of the Invention

The present invention relates generally to a golf swing training aid, and more particularly to a golf swing training aid that helps a golfer learn how to execute a proper swing.

2. Description of the Prior Art

Generally, in case of a full swing, irrespective of an upright swing or a flat swing, it is required that a club face of a golf club held by a golfer is at right angles to a target line at the rear of a golf ball. In case of a back swing or an impact swing, the club face of the golf club should be at right angles to a swing orbit so that the golf ball flies away accurately toward the target line after the golfer hits a golf ball. These requirements are applicable to a half swing or a putt.

A golfer must have much exercise and correct swing flaws until he or she masters a proper swing. When a golfer does not maintain an optimum swing, a golf ball is often sliced or hooked. One of the common reasons is that the golfer twists his or her wrists or arms unconsciously after his or her address position in the course of a swing. As a result, the club face may be opened or closed, which makes the golf ball sliced or hooked. That is, it is important to maintain the proper position of the arms or the wrists of the golfer in the course of a swing.

In order to execute a proper swing, the line connecting both elbows should run parallel with the line of his or her shoulders when the address or the back swing is done, and the wrists of the golfer should not be cocked until they reach the swing top. The golfer may learn the proper swing by virtue of plentiful exercises. However, there are instances where the golfer takes improper swing posture unconsciously.

Several exercising aids have been proposed for correcting golf swing flaws. One of the prior exercising aids, which has a simple structure, has been provided for preventing the wrists of the golfer from being cocked excessively. Another of the prior exercising aids, which has a complex structure, has been provided for correcting the posture of the entire body of the golfer. These exercising aids, however, are not capable of effectively forcing golfer's arms to maintain a proper swing.

SUMMARY OF THE INVENTION

It is therefore an object of the present invention to provide an improved golf swing training aid.

It is another object to provide a training aid which teaches a golfer how to execute a proper swing.

It is also an object to provide a training aid which prevents the wrists of a golfer from being improperly cocked.

It is further an object to provide a training aid which is capable of forcing the golfer's arms to maintain a proper swing.

It is still further an object to provide a training aid, which is capable of fixing the posture of the arms of the golfer correctly from an address position and preventing the wrists of the golfer from moving from side to side.

It is yet further an object to provide a training aid which is capable of maintaining the triangular posture formed by both of the arms and the shoulder line of the golfer until the putting action is finished in case of the putting training.

In order to achieve the above and other objectives, the preferred embodiments of the present invention include: a first supporting member having two branches and an end portion, the two branches disposed at the rear of the end portion, the two branches forming a space so that a golfer may grip a golf club between the two branches; a club holder mounted on the end portion of the first supporting member for holding the golf club; a couple of second supporting members coupled to two branches of the first supporting member for supporting the back portions of the golfer's arms; and couplers coupling two branches of the first supporting member to the second supporting members in such a manner that the first supporting member and the couple of second supporting members are movable articulately.

The end portion of the first supporting member may be formed as a rod.

It is preferred that one of two branches is longer than the other.

It is preferred to include a combining band member mounted on the second supporting members to adjust a distance between the second supporting members.

The combining member preferably includes a first band having a hook button, one end of the first band connected to one of the couple of second supporting members, and a second band having hook holes, one end of the second band connected to the other of the couple of second supporting members, the hook button of the first band selectively inserted in one of the hook holes of the second band.

The present invention preferably further includes a direction indicator mounted on the club holder so that the posture of the golfer can be checked.

It is preferred that the coupler is comprised of a couple of brackets and a bolt-nut member. Each of the couple of brackets has a first arm fixed to the branch of the first supporting member and a second arm fixed to the second supporting member by means of the bolt-nut member so that an angle of the second supporting members can be adjusted.

It is also preferred that each of the second supporting members has an arc shape to support lower arms of the golfer comfortably.

In the first preferred embodiment of the invention, the club holder includes a first plate mounted on the end portion of the first supporting member, a second plate hinged to the first plate. One of the first and the second plates has a latch, and the other has a hook so that the latch engages with and disengages from the hook to close and open the club holder. The golf club is disposed between the first plate and the second plate.

It is preferred that the first plate and the second plate have a pad, respectively to prevent a surface of the golf club.

In the second preferred embodiment of the invention, the club holder includes a main body connected to the first supporting member, a first plate, a second plate, a fastener, and a connecting pin. The first plate is mounted in the main body. The second plate is mounted at a position of the main body facing the first plate. The golf club is inserted in a front inserting hole provided in the main body. The second plate is movable toward and away from the first plate. The fastener is mounted in the main body and connected to the second plate by means of a connecting pin whereby the second plate moves toward the fist plate when the fastener is fastened, and moves away from the first plate when the fastener is released.

In the third preferred embodiment of the present invention, the main body has an opening in one of its sides so that the golf club can be inserted in the opening of the main body.

BRIEF DESCRIPTION OF THE DRAWINGS

The preferred embodiments of the present invention will now be described by way of example with reference to the accompanying drawings in which.

DETAILED DESCRIPTION OF THE PREFERRED EMBODIMENTS

A golf swing training aid according to the present invention will now be described in detail with reference to the accompanying drawings.

Figure 1:
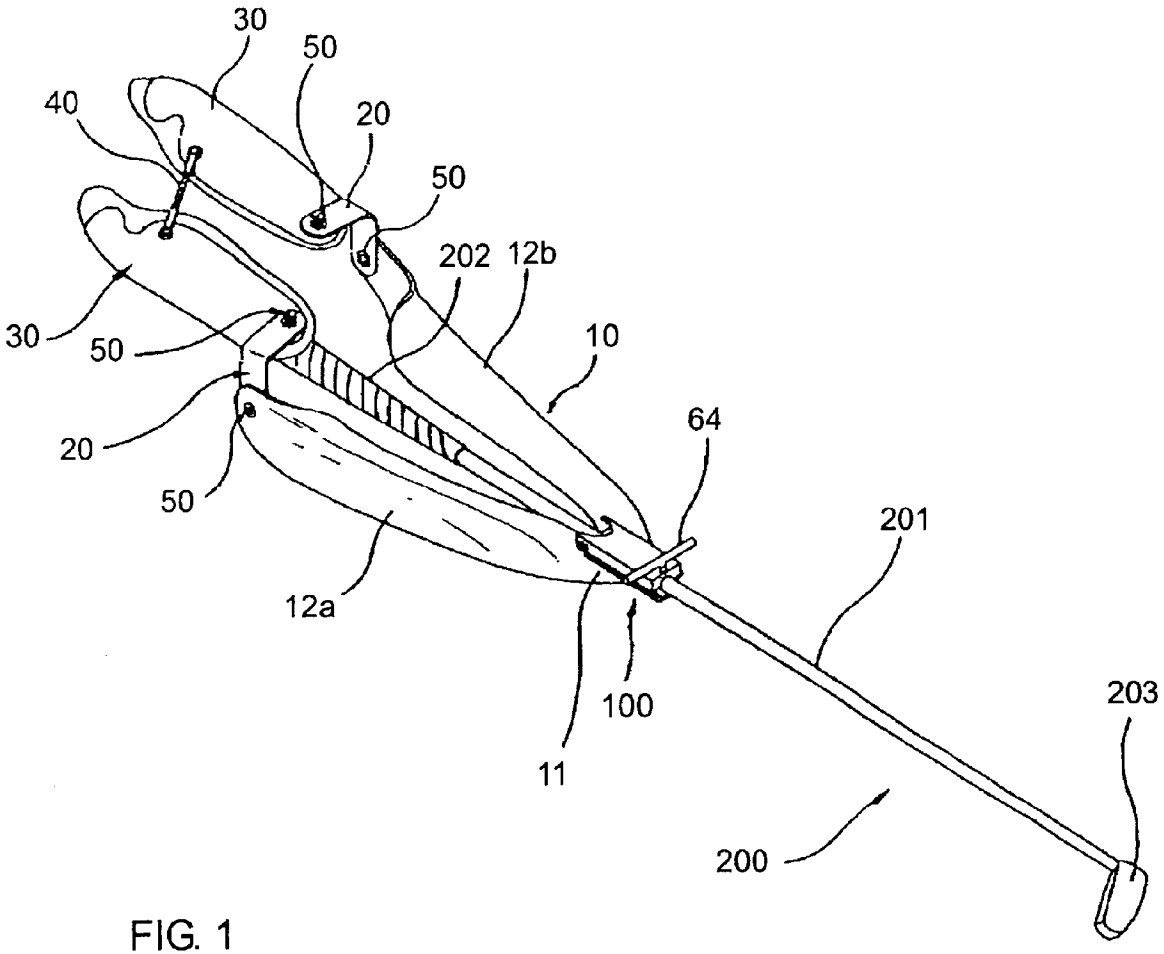
FIG. 1 is an illustrative perspective view of a golf swing training aid according to the first embodiment of the present invention when a golf club is held in the training aid.
Figure 5:
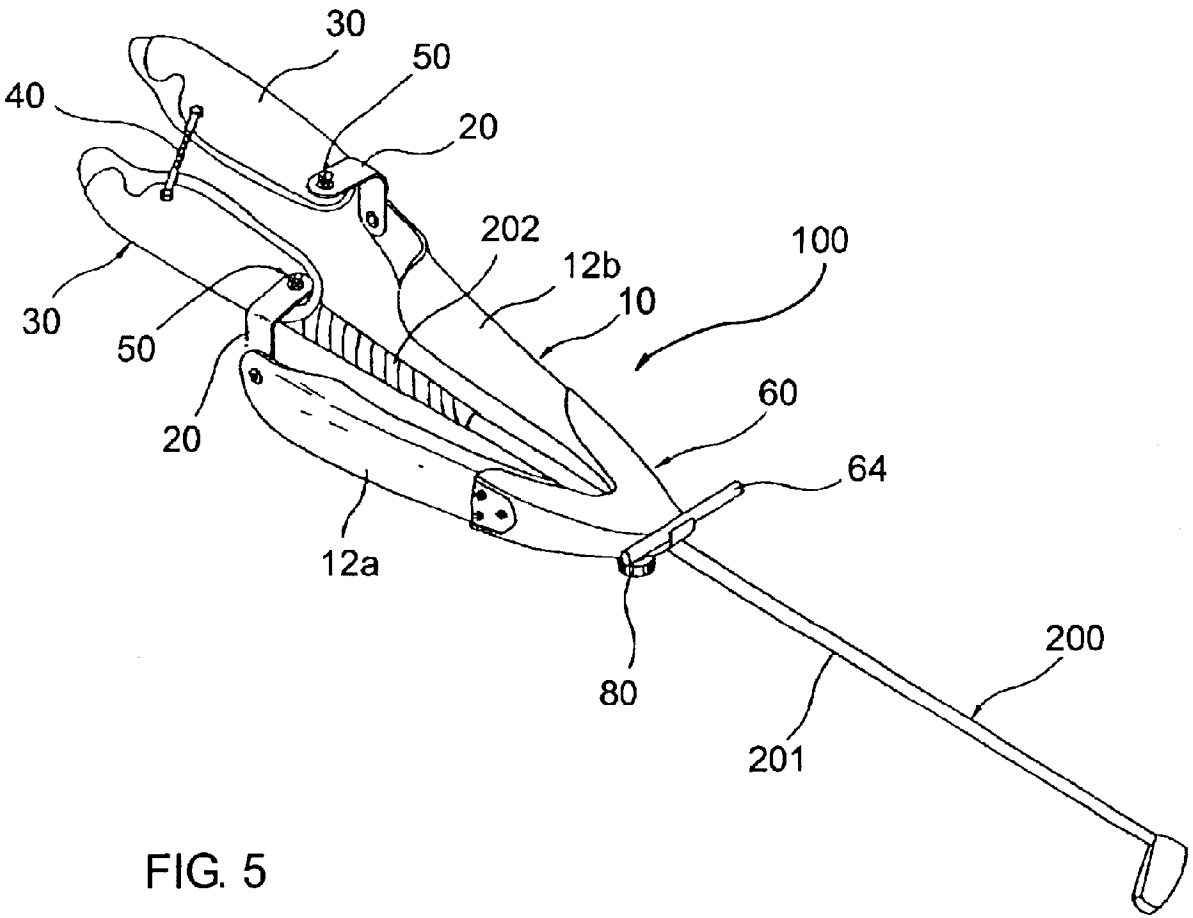
FIG. 5 is an illustrative perspective view of the golf swing training aid according to a second preferred embodiment of the present invention.
Figure 8:
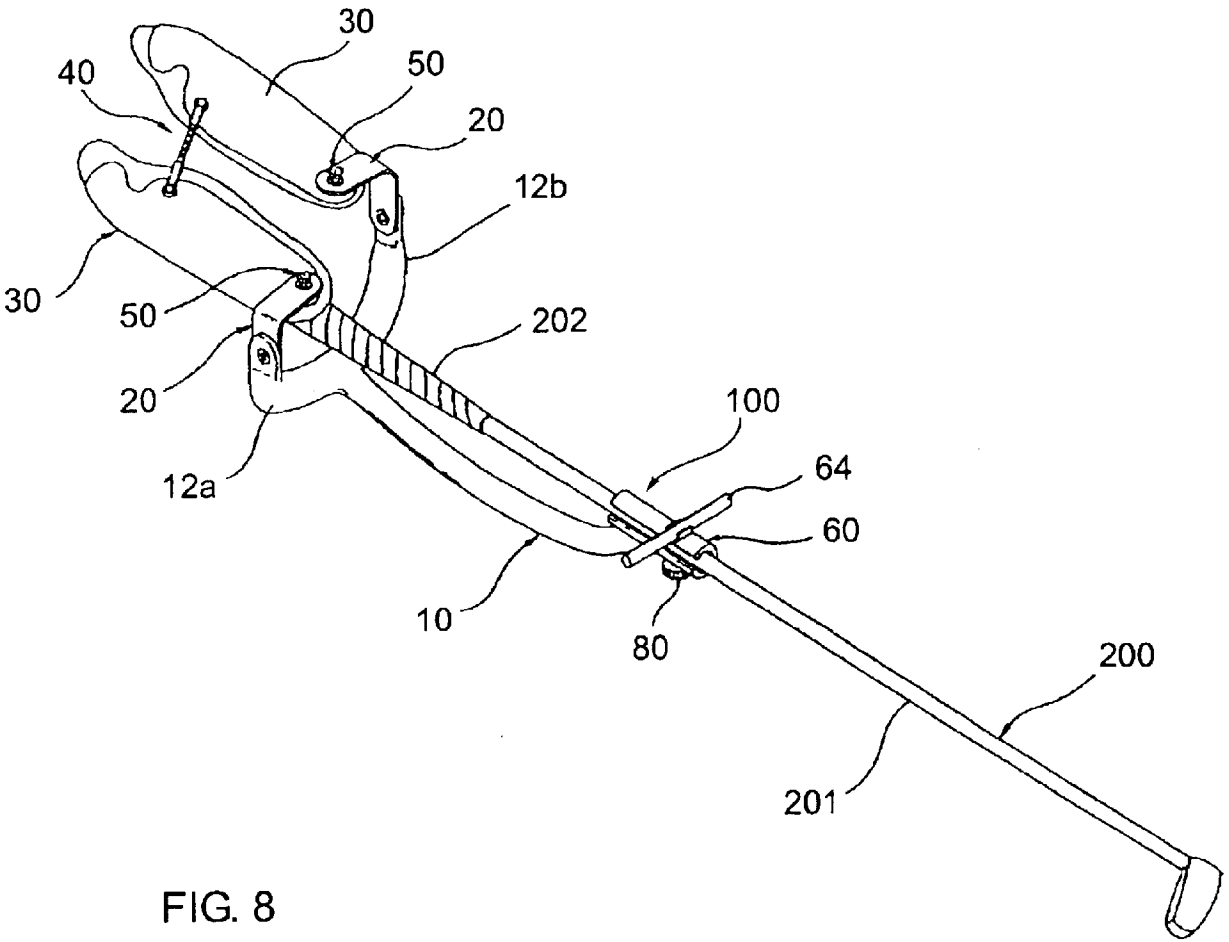
FIG. 8 is an illustrative perspective view of the golf swing training aid according to a third preferred embodiment of the present invention.

As shown in FIG. 1, FIG. 5, and FIG. 8, a first supporting member 10 has an end portion 11 and two branch portions 12 of which a vertex is positioned at the end portion 11 and which form a space so that a golfer may grip the grip portion of the golf club.

Second supporting members 30 are connected to ends of the branch portions 12*a* and 12*b* by means of couplers 20 for supporting the back portions of the lower arms of the golfer. The golfer's arms form a "V" shape when the golfer grips the golf club 200. In case that a golfer is a right-handed person, the branch portions 12*a* and 12*b* of the first supporting member 10 are configured in such a manner that the length of the left branch portion 12*b* is slightly longer than that of the right branch portion 12*a*. Under this configuration, it is easy and convenient to support the back portions of the lower arms of the golfer according to the deviation of the position of the elbows. In case that a golfer of the golf swing training aid is a left-handed person, the construction is the very reverse to the construction as mentioned above in connection with the right-handed golfer.

It is preferable that the second supporting members 30 are constructed in an arc-like shape so that the back portions of the lower arms of the golfer are supported comfortably.

Figure 3:
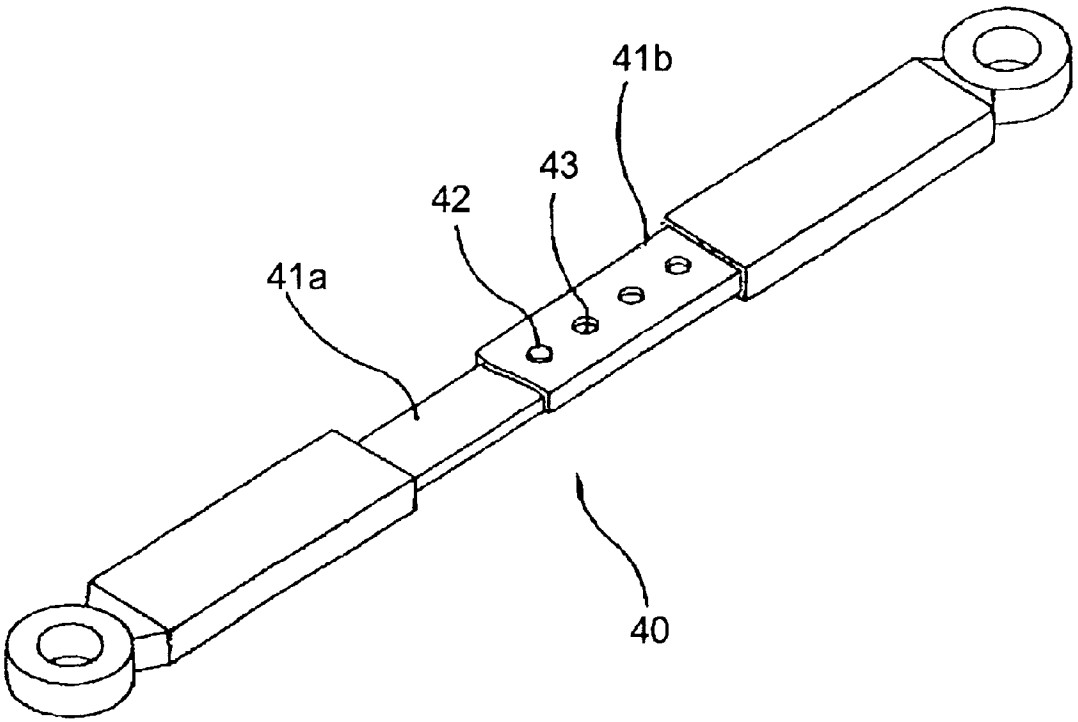
FIG. 3 is an illustrative perspective view of a combining band member of the present invention.

The second supporting members 30 may be provided with a combining band member 40, whose length is adjustable and fixed to prevent any widening of two arms of the golfer when he or she practices putting actions. As shown in FIG. 3, the combining band member 40 includes two bands 41*a* and 41*b*. One end of each band 41*a*, 41*b* is connected to one end of each second supporting member 30. One of the bands 41*a* has a hook button 42, and the other 41*b* has hook holes 43. The hook button 42 is engaged with one of the hook holes 43 selectively so that the distance between the second supporting members 30 can be adjusted.

The coupler 20 is preferably constructed in approximate "]" shape which is called as a bracket. That is, the coupler preferably has two arms. One of the arms is fixed to the branch of the first supporting member 10, and the other is fixed to the second supporting member 30. The couplers 20 couple the branches 12*a* and 12*b* of the first supporting member 10 to the second supporting members 30 by means of bolt-nut members 50 in such a manner that the first supporting member and the second supporting members are moved articulately. As the bolt-nut member 50, a bolt with the big head or a butterfly nut may be used. Such head and nut can be fastened or unfastened easily by the golfer in order to limit right and left rotation of the wrists of the golfer.

A club holder 100 is disposed at the end portion 11 for holding fixedly the shaft 201 of the golf club 200.

Figure 2:
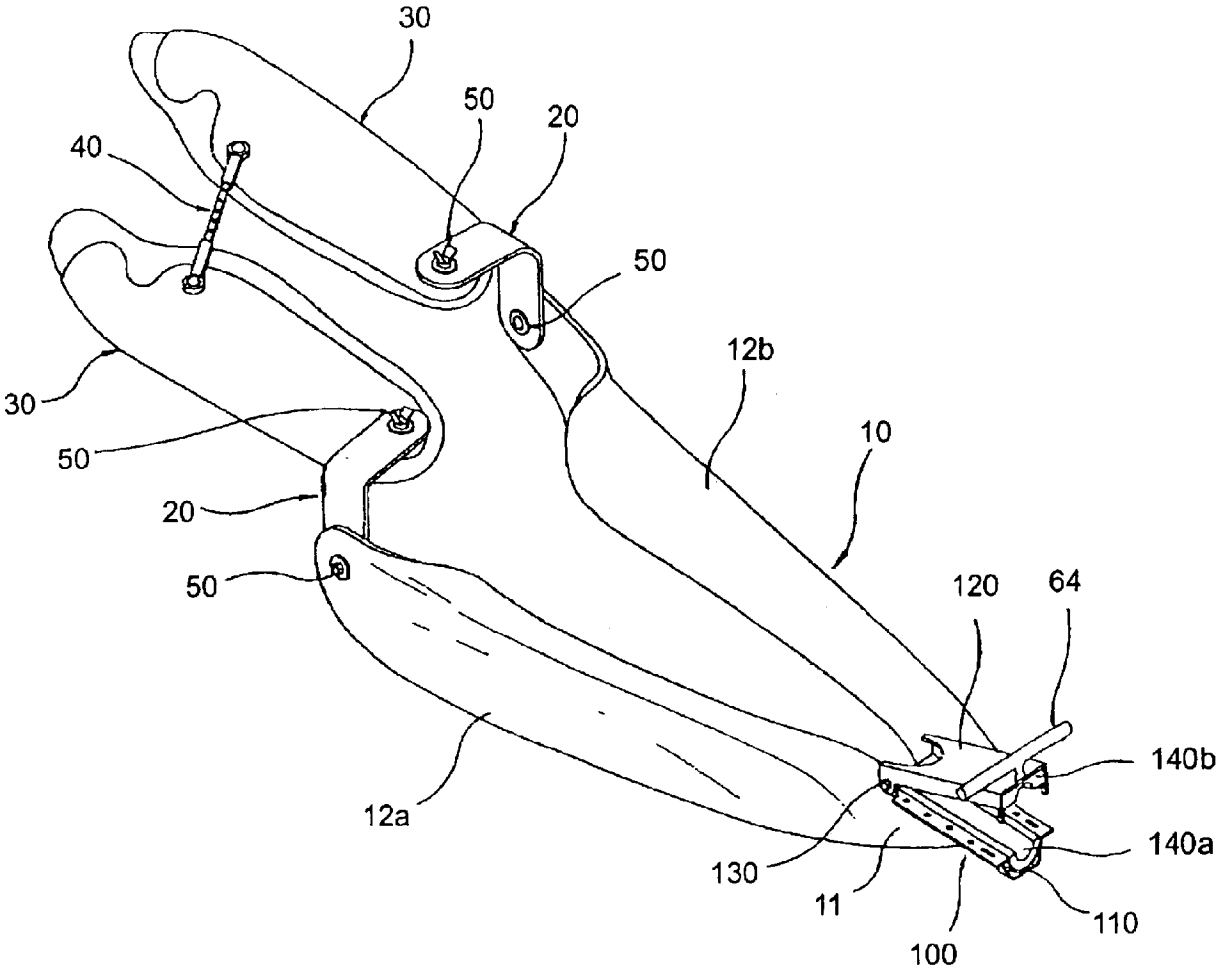
FIG. 2 is an illustrative perspective view of the golf swing training aid according to a first preferred embodiment of the present invention.
Figure 4:
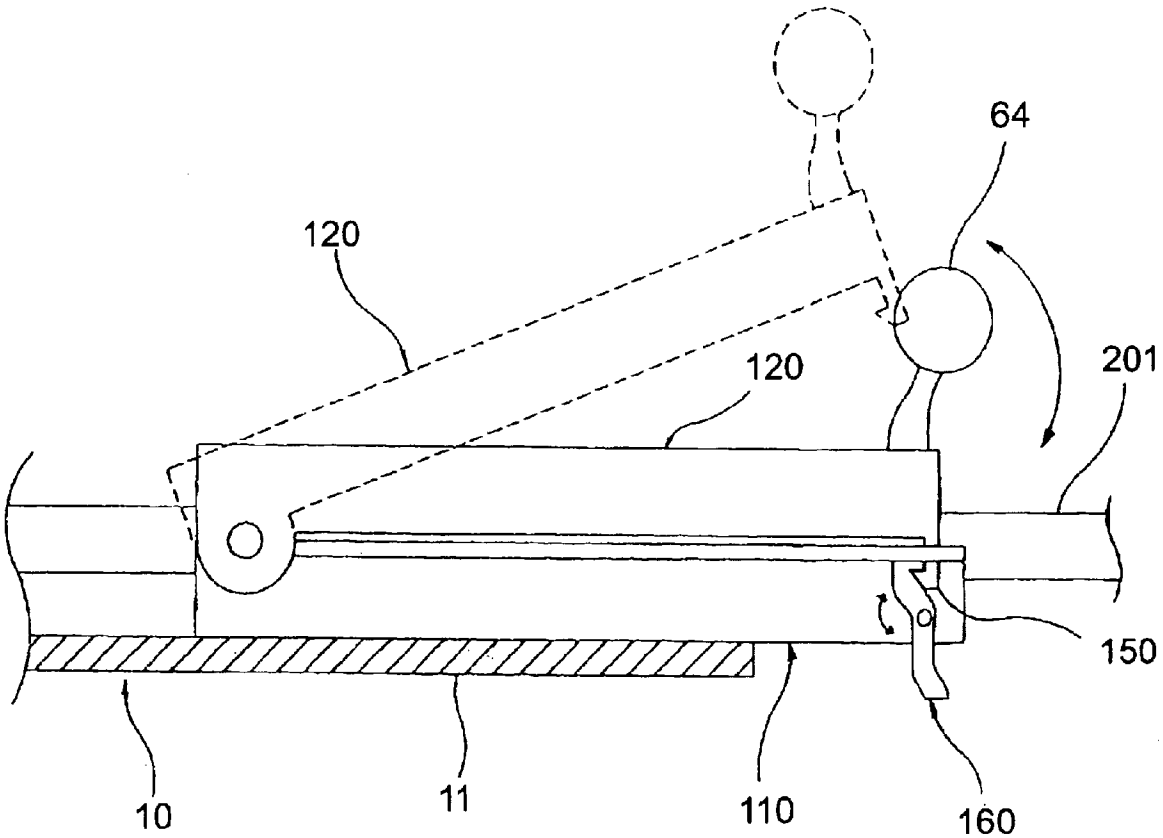
FIG. 4 is an illustrative cross sectional view showing a locking state of the club holder of the first embodiment of the present invention.

As shown in FIG. 2 and FIG. 4, in a first preferred embodiment of the present invention, the club holder 100 has a stationary plate 110 and a moving plate 120 hinged to the rear end of the stationary plate 110 so that the club holder can be opened or closed by moving the moving plate 120 from or to the stationary plate 110. The stationary plate 110 and the moving plate 120 are provided at the interior thereof with pads 140*a* and 140*b*, respectively, for protecting a surface often shaft 201 of the golf club 200 and holding the golf club 200 more tightly. The pads 140*a* and 140*b* are preferably made of elastic material.

One of the stationary plate 110 and the moving plate 120 is provided at its end with a latch 150 while a hook 160 is hinged to the end of the other of the stationary plate 110 and the moving plate 120. The latch 150 is engaged with or disengaged from the hook 160 so that the moving plate 120 can be locked or released.

Figure 6:
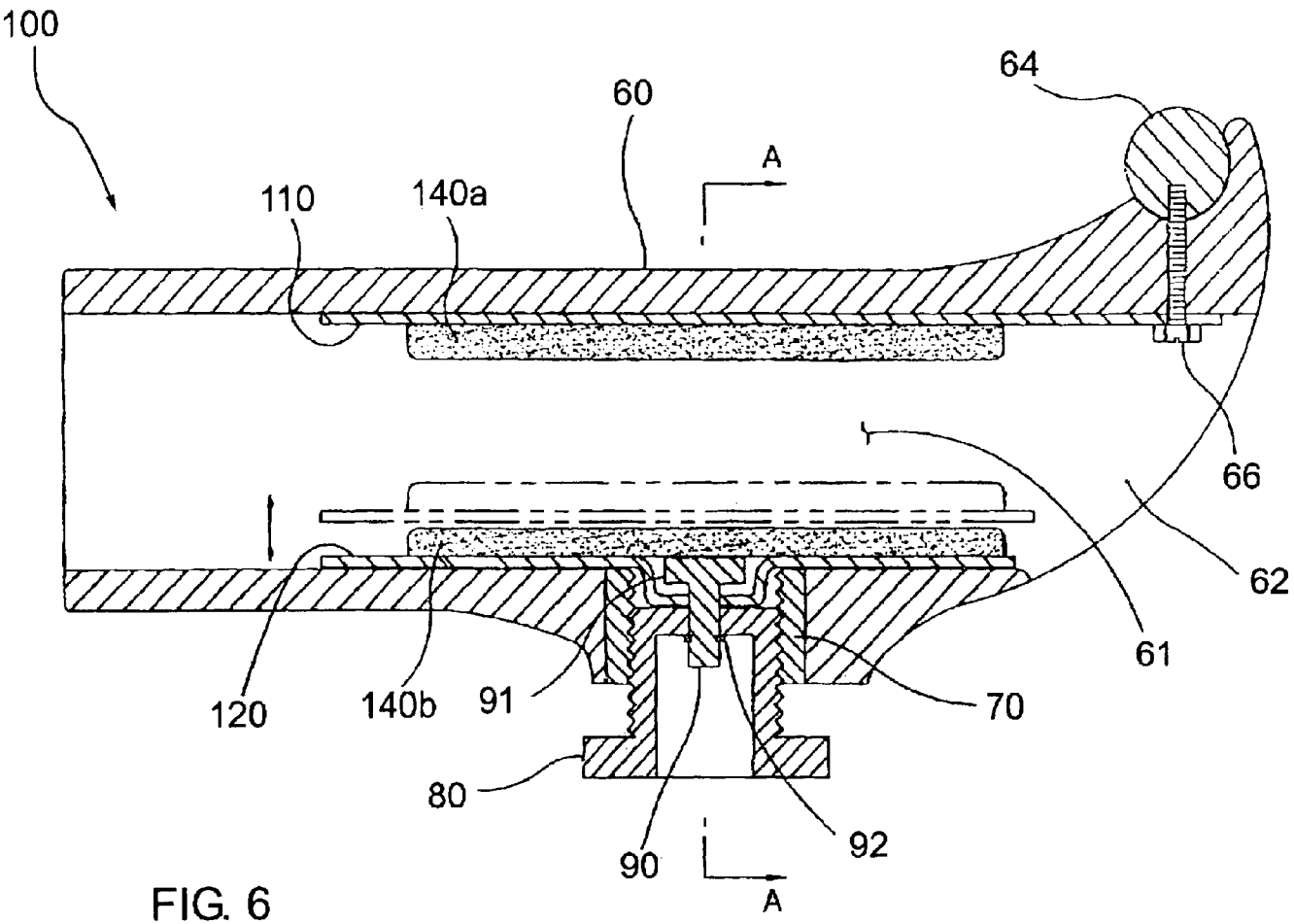
FIG. 6 is a sectional view of the club holder illustrated in FIG. 5.
Figure 7:
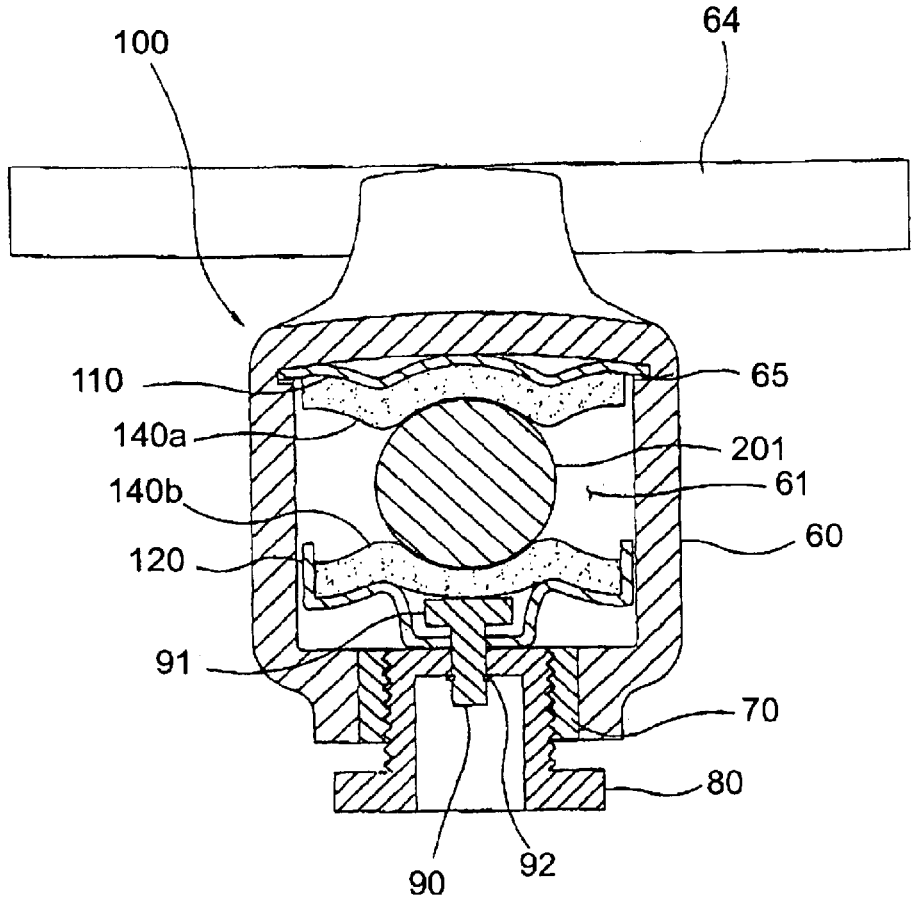
FIG. 7 is a cross sectional view taken along the line A—A of FIG. 6.

In a second embodiment of the present invention as shown in FIG. 5, FIG. 6 and FIG. 7, the club holder 100 is provided at the end of the first supporting member 10. The club holder has a main body 60, a stationary plate 110 and a moving plate 120. It is preferred that the main body 60 has a shape similar to an end portion of the first supporting member 10 so that the end portion of the first supporting member 10 is inserted therein. The stationary plate 110 and the moving plate 120 preferably have the pads 140*a* and 140*b*, respectively. The stationary plate 110 is mounted at an inner side of the main body 60, and the moving plate 120 is mounted at the inner side opposite to the stationary plate 110. The moving plate 120 is connected to a fastener 80 which is threaded into a nut 70 to move the moving plate 120 toward the stationary plate 110. The nut 70 is mounted in the main body 60. The moving plate 120 moves toward or away from the stationary plate 110 according to the forward or backward rotation of the fastener 80 so that the shaft 201 of the golf club inserted between the stationary plate 110 and the moving plate 120 can be held fixedly or released.

The stationary plate 110 is attached to the inner side of the main body 60 by connecting means. As an example of the connecting means, grooves 65 are provided at both sides of the inner wall of the main body 60 so that both ends of the stationary plate 110 are inserted therein. Alternatively, the stationary plate 110 may be fixed by means of a screw 66 as shown in FIG. 6.

The connecting pin 90, by which the moving plate 120 is connected with the fastener 80, is inserted through the fastener 80 and fixed by means of a key 92 while a head 91 of the connecting pin 90 is caught by the moving plate 120.

The grip portion 202 of the golf club and then the shaft 201 of the golf club may be inserted into the inner space 61 of the first supporting member 10 through a front inserting hole 62.

Figure 9:
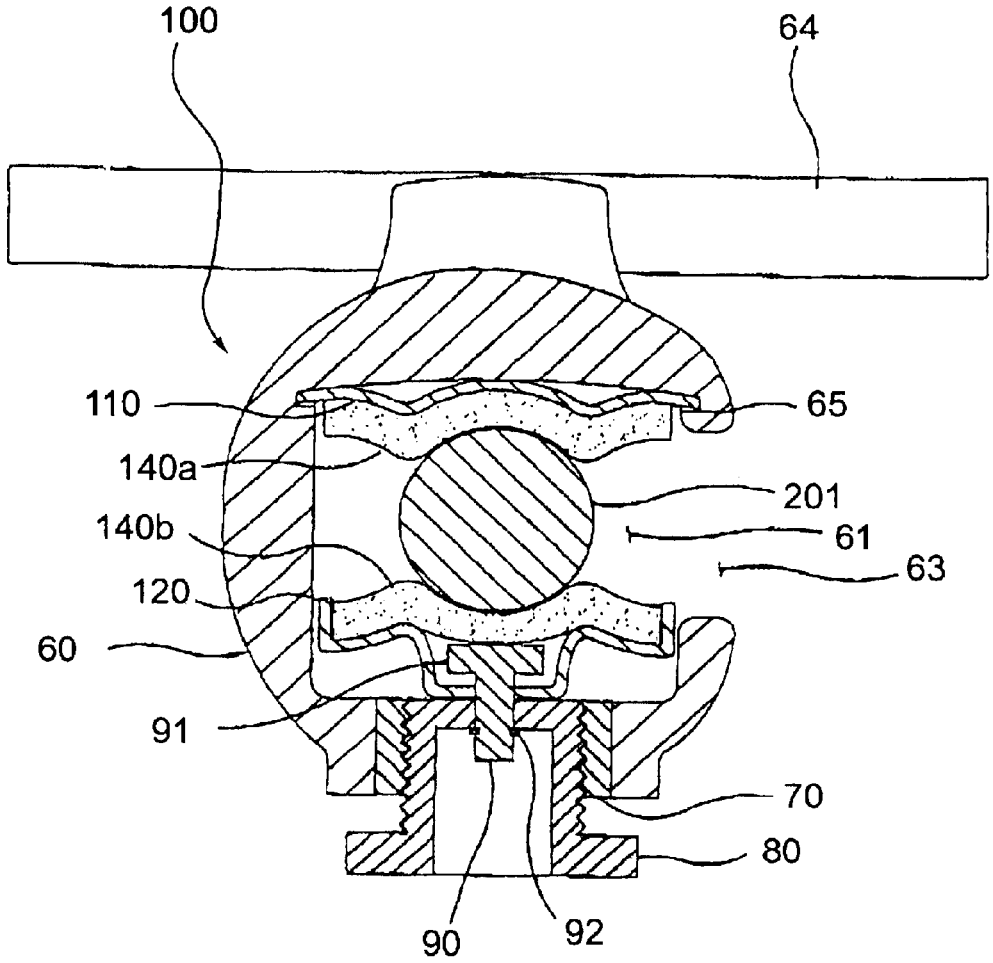
FIG. 9 is a sectional view of the club holder illustrated in FIG. 8.

In a third embodiment of the present invention as shown in FIG. 8 and FIG. 9, the main body 60 maybe provided with an open side 63 so that the golf club 200 maybe inserted through the open side 63.

As shown in FIG. 8, the first supporting member 10 may have a rod portion at its end and two branch portions 12*a* and 12*b* formed at the rear end of the rod.

As shown in FIG. 2, FIG. 5 and FIG. 8, at the upper end portion of the club holder 100 is mounted a direction indicating bar 64 at right angles to the shaft 201 of the golf club 200 so that the position of the back swing top can be checked.

The use of the golf swing training aid according to the present invention will be described herein below.

First, the shaft 201 of the golf club 200 is held by the club holder 100. In case that the club holder 100 is of open and close type, as shown in FIG. 2, the moving plate 120 is released from the stationary plate 110, and then the golf club is inserted between the stationary plate 110 and the moving plate 120. At this time, the grip portion 202 is positioned between the branch portions 12*a* and 12*b*. After the shaft 201 is inserted between the stationary plate 110 and the moving plate 120, the moving plate 120 is closed, and then the latch 150 is engaged with the hook 160 so that the shaft 201 of the golf club is held fixedly. Alternatively, as shown in FIG. 5 or FIG. 8, the shaft 201 of the golf club is inserted between the stationary plate 110 and the moving plate 120 through the front inserting hole 62 or the open side 63, and then the moving plate 120 approaches to the stationary plate 110 by rotating the fastener 80 so that the shaft 201 of the golf club 200 can be held fixedly.

After the shaft 201 of the golf club is held fixedly by the club holder 100 as mentioned above, the golfer holds the grip portion 202 positioned between the branch portions 12*a* and 12*b* of the first supporting member 10. The two arms of the golfer get together in the form of "V", and the lower arms of the golfer are supported by the second supporting members 30. Consequently, the wrists of the golfer who is holding the grip portion of the golf club are not cocked, and thus the improper twisting of the arms is prevented.

The golfer is able to practice the swing action at the posture as mentioned above. This practice helps preventing any opening or closing of the club face and excessive cocking of the arms.

On the other hand, in case that the angle of the arms is adjusted to take other postures, such as putting action, it is required to unfasten slightly the bolt-nut member 50*a* and 50*b* of the couplers 20 so that the angle of the second supporting members 30 can be adjusted, and to fasten again the bolt-nut member 50*a* and 50*b* so that the golfer can practice the required swing action. In addition, in case that it is required to prevent any widening between the two arms in the course of the swing, the hook button 42 of the band 41*a* is inserted into the selected hook hole 43 of the band 41*b* so as to adjust the distance between the second supporting members 30.

Figure 10:
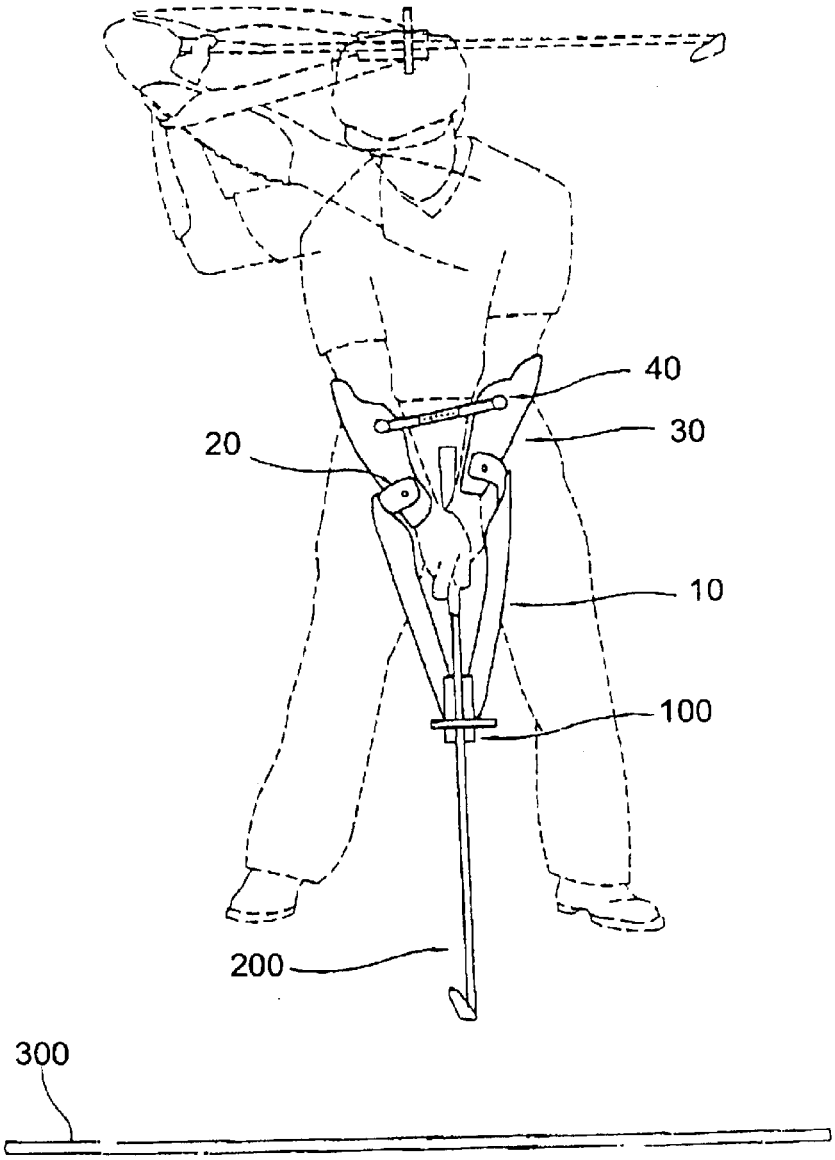
FIG. 10 illustrates a state that the golf swing training aid according to the present invention is used.

When the golfer practices the swing action as mentioned above, the direction indicating bar 64 mounted at the upper end portion of the club holder 100 is at right angles to the shaft 201 of the golf club. As a result, the golfer can check whether his or her swing posture is correct or wrong looking into a mirror 300. For example, as shown in FIG. 10, if the direction indicating bar 64 is shown at right angles to the ground in the mirror 300, the golfer takes a correct posture. However, if the direction indicating bar 64 is not shown at right angles to the ground in the mirror 300, the golfer takes a wrong posture. Consequently, the golfer may correct swing flaws looking into the mirror so that he or she can always maintain the right posture when he or she practices the swing actions.

With the golf swing training aid according to the present invention, the golf club can be held easily in the club holder, the golfer's lower arms can be supported by the second supporting members at the address position so that the grip posture can be fixed, and any rotation of the wrists from side to side can be prevented. Consequently, it is possible to practice the swing after optimized swing position is taken. Furthermore, it is possible to maintain the triangular shape formed by both arms and the shoulder line of the golfer until the putting action is finished in case of the putting training.

Although the structure of the golf swing training aid according to the preferred embodiment of the present invention has been fully described herein with reference to the accompanying the drawings, such description and drawings are merely for illustrative purposes only, and it is to be understood that various changes or modifications will be apparent to those skilled in the art without departing from the spirit of the invention.

What is claimed is:

1. A golf swing training aid for training a golfer, comprising:

a first supporting member having two branches and an end portion, said two branches disposed at the rear of said end portion, said two branches forming a space so that a golfer may grip a golf club between said two branches;

a club holder mounted on the end portion of said first supporting member for holding the golf club;

a pair of second supporting members coupled to free ends of said two branches of said first supporting member for supporting the forearms of the golfer; and couplers coupling said two branches of said first supporting member to said pair of second supporting members, respectively, to make said first supporting member and said pair of second supporting members articulately movable.

2. The golf swing training aid of claim 1, wherein one of said two branches is longer than the other of said two branches.

3. The golf swing training aid of claim 1, further comprising a combining band member mounted on said pair of second supporting members, a length of said combining band member being adjustable so that a distance between said pair of second supporting members can be adjusted.

4. The golf swing training aid of claim 3, further comprised of said combining band member comprising:

a first band having a hook button, one end of said first band connected to one of said pair of second supporting members; and a second band having hook holes, one end of said second band connected to the other of said pair of second supporting members, said hook button of said first band selectively inserted in one of said hook holes of said second band.

5. The golf swing training aid of claim 1, further comprising a direction indicator mounted on said club holder so that the posture of the golfer can be checked.

6. The golf swing training aid of claim 5, wherein said direction indicator comprises a bar mounted at an upper end of said club holder, and said bar is at right angles to a shaft of the golf club.

7. The golf swing training aid of claim 1, wherein said couplers comprises a pair of brackets and bolt-nut members, each of said pair of brackets comprises a first arm fixed to the branch of said first supporting member and a second arm fixed to said second supporting member by means of said bolt-nut members so that an angle of said pair of second supporting members can be adjusted.

8. The golf swing training aid of claim 1, wherein each of said pair of second supporting members is an arc shape to support the forearms of the golfer.

9. The golf swing training aid of claim 1, wherein said club holder comprises:

a first plate mounted on said end portion of said first supporting member, said first plate having a first pad;

a second plate hinged to said first plate, said second plate having a second pad, said first pad and said second pad making a space for holding a golf club, said first pad and said second pad directly contacting the golf club when the golf club is held in said golf club holder;

a latch mounted on one of said first plate and said second plate; and a hook mounted on the other of said first plate and said second plate, said latch engaging with and disengaging from said hook to close and open said club holder.

10. The golf swing training aid of claim 1, wherein said club holder comprises:

a main body connected to said first supporting member, said main body having an opening into which the golf club can be inserted;

a first plate mounted on said main body, said first plate having a first pad;

a second plate mounted at a position of said main body facing said first plate, said second plate being movable toward and away from said first plate, said second plate having a second pad, said first pad and said second pad directly contacting the golf club when the golf club is held in said club holder; and a fastener mounted in said main body and coupled to said second plate whereby said second plate moves toward said fist plate when said fastener is fastened and said second plate moves away from said first plate when said fastener is released.

11. The golf swing training aid of claim 10, further comprised of said main body having a threaded opening into which said fastener is threaded.

12. The golf swing training aid of claim 10, wherein said opening is a hole into which the golf club can be inserted.

13. The golf swing training aid of claim 10, wherein said opening is positioned in one side of said main body of said club holder for laterally inserting the golf club.

14. The golf swing training aid of claim 10, further comprised of:

said end portion of said first supporting member comprising a rod; and said two branches formed at the rear of said end portion.

15. The golf swing training aid of claim 10, wherein one of said two branches is longer than the other.

16. The golf swing training aid of claim 10, wherein said main body has a pair of grooves each positioned at a first side wall and a second side wall facing said first side wall of said main body, and a width of said first plate corresponds to a distance between said pair of grooves to be inserted in said main body along said pair of grooves.

17. The golf swing training aid of claim 10, wherein said fastener is coupled to said second plate through a connecting pin.

18. A golf swing training aid, comprising:

a first supporting member having two branches and an end portion, said two branches disposed at the rear of said end portion, said two branches forming a space so that a golfer may grip a golf club between said two branches;

a club holder mounted on the end portion of said first supporting member for holding the golf club, said club holder comprising;

a first plate mounted on said end portion of said first supporting member, said first plate having a first pad;

a second plate hinged to said first plate, said second plate having a second pad, said first pad and said second pad making a space for holding a golf club, said first pad and said second pad directly contacting the golf club when the golf club is held in said golf club holder;

a latch mounted on one of said first plate and said second plate; and a hook mounted on the other of said first plate and said second plate, said latch engaging with and disengaging from said hook to close and open said club holder;

a pair of second supporting members coupled to said two branches of said first supporting member for supporting back portions of golfer's arms;

couplers coupling said two branches of said first supporting member to said pair of second supporting members, respectively, to make said first supporting member and said pair of second supporting members articulately movable; and a combining band member mounted on said pair of second supporting members to prevent a distance between two arms of the golfer from widening in the course of a golf swing, a length of said combining band member being adjustable to set a desired distance between two arms of the golfer.

19. A golf swing training aid, comprising:

a first supporting member having two branches and an end portion, said two branches disposed at the rear of said end portion, said two branches forming a space so that a golfer may grip a golf club between said two branches;

a club holder mounted on the end portion of said rod for holding the golf club, said club holder comprising;

a main body mounted on said rod of said first supporting member, said main body having a vertical hole into which the golf club can be inserted;

a first plate mounted on said main body, said first plate having a first pad;

a second plate mounted at a position of said main body facing said first plate, said second plate being movable toward and away from said first plate, said second plate having a second pad, said first pad and said second pad directly contacting the golf club when the golf club is held in said club holder; and a fastener mounted in said main body and coupled to said second plate whereby said second plate moves toward said fist plate when said fastener is fastened and said second plate moves away from said first plate when said fastener is released;

a pair of second supporting members coupled to said two branches of said first supporting member for supporting back portions of golfer's arms;

couplers coupling said two branches of said first supporting member to said pair of second supporting members, respectively, to make said first supporting member and said pair of second supporting members articulately movable; and a combining band member mounted on said pair of second supporting members to prevent a distance between two arms of the golfer from widening in the course of a golf swing, a length of said combining band member being adjustable to set a desired distance between two arms of the golfer.

20. A golf swing training aid, comprising:

a first supporting member having two branches and a rod, said two branches disposed at the rear of said rod, said two branches forming a space so that a golfer may grip a golf club between said two branches;

a club holder mounted on said rod of said first supporting member for holding the golf club, said club holder comprising;

a main body connected to said first supporting member, said main body having a side opening into which the golf club can be inserted;

a first plate mounted on said main body, said first plate having a first pad;

a second plate mounted at a position of said main body facing said first plate, said second plate being movable toward and away from said first plate, said second plate having a second pad, said first pad and said second pad directly contacting the golf club when the golf club is held in said club holder; and a fastener mounted in said main body and coupled to said second plate whereby said second plate moves toward said fist plate when said fastener is fastened and said second plate moves away from said first plate when said fastener is released;

a pair of second supporting members coupled to said two branches of said first supporting member for supporting back portions of golfer's arms;

couplers coupling said two branches of said first supporting member to said pair of second supporting members, respectively, to make said first supporting member and said pair of second supporting members articulately movable; and a combining band member mounted on said pair of second supporting members to prevent a distance between two arms of the golfer from widening in the course of a golf swing, a length of said combining band member being adjustable to set a desired distance between two arms of the golfer.

* * * * *